US010323916B2

(12) United States Patent
Grace

(10) Patent No.: US 10,323,916 B2
(45) Date of Patent: Jun. 18, 2019

(54) MECHANICAL BROADHEAD

(71) Applicant: Grace Engineering Corp., Memphis, MI (US)

(72) Inventor: Nathaniel E. Grace, Fort Gratiot, MI (US)

(73) Assignee: Grace Engineering Corp., Memphis, MI (US)

( * ) Notice: Subject to any disclaimer, the term of this patent is extended or adjusted under 35 U.S.C. 154(b) by 0 days.

(21) Appl. No.: 16/015,501

(22) Filed: Jun. 22, 2018

(65) Prior Publication Data

US 2019/0078863 A1 Mar. 14, 2019

Related U.S. Application Data

(62) Division of application No. 15/699,203, filed on Sep. 8, 2017, now Pat. No. 10,030,949.

(51) Int. Cl.
*F42B 6/08* (2006.01)

(52) U.S. Cl.
CPC ..... *F42B 6/08* (2013.01)

(58) Field of Classification Search
CPC ..... F42B 6/08
See application file for complete search history.

(56) References Cited

U.S. PATENT DOCUMENTS 5,082,292 A 1/1992 Puckett et al.
5,090,709 A 2/1992 Johnson
5,102,147 A 4/1992 Szeluga
5,112,063 A 5/1992 Puckett
5,286,035 A 2/1994 Ward
5,417,440 A 5/1995 Barrie et al.
5,564,713 A 10/1996 Mizek et al.
5,941,784 A 8/1999 Mizek
6,174,252 B1 1/2001 Mizek
6,200,237 B1 3/2001 Barrie
6,283,880 B1 9/2001 Barrie
6,287,224 B1 9/2001 Liechty, II
6,517,454 B2 2/2003 Barrie et al.
6,626,776 B2 9/2003 Barrie et al.
6,669,586 B2 12/2003 Barrie et al.
6,910,979 B2 6/2005 Barrie et al.
7,182,706 B2 2/2007 Barrie
7,226,375 B1 6/2007 Sanford
7,677,995 B1 3/2010 Sanford
(Continued)

*Primary Examiner* — John A Ricci
(74) *Attorney, Agent, or Firm* — Warner Norcross + Judd LLP

(57) ABSTRACT

A mechanical broadhead, which has blades movable from a retracted mode to a deployed mode, is provided with ball and socket members that hold the blades in the retracted mode, and selectively release the blades to the deployed mode. The ball and socket members, which can be on the blades and/or on a retainer element, can be snapped together to provide an audible snap confirming locking of the blades in the retracted mode. The mechanical broadhead can include first and second ferrule portions removably joined with one another. The second ferrule portion can acquire a blocking mode to block a removal opening of a ferrule slot defined in the first ferrule portion so that blade cannot be removed from respective ferrule slots. The second ferrule portion can achieve a removal mode so that the blades can be removed from the slots.

16 Claims, 9 Drawing Sheets

(56) References Cited

U.S. PATENT DOCUMENTS

| | | | | |
|---|---|---|---|---|
| 7,713,151 | B2 | 5/2010 | Fulton | |
| 7,771,298 | B2 | 8/2010 | Pulkrabek | |
| 7,905,802 | B2 | 3/2011 | Erhard | |
| 7,951,024 | B2 | 5/2011 | Mizek | |
| 8,197,367 | B2 | 6/2012 | Pulkrabek et al. | |
| 8,398,510 | B1 | 3/2013 | Mizek et al. | |
| 8,449,415 | B2 | 5/2013 | Grace | |
| 8,449,416 | B2 | 5/2013 | Grace et al. | |
| 8,469,842 | B2 | 6/2013 | Mizek et al. | |
| 8,469,843 | B2 | 6/2013 | Mizek et al. | |
| 8,512,179 | B2 | 8/2013 | Pulkrabek et al. | |
| 8,684,869 | B1 | 4/2014 | Perry | |
| 8,758,176 | B2 | 6/2014 | Pedersen | |
| 8,801,552 | B2 | 8/2014 | Miles | |
| 8,911,311 | B1 | 12/2014 | Mizek et al. | |
| 9,068,806 | B2 | 6/2015 | Pedersen | |
| 9,228,813 | B1 | 1/2016 | Pedersen | |
| 9,329,006 | B1 * | 5/2016 | Hansen | F42B 6/08 |
| 9,341,449 | B2 | 5/2016 | Pedersen | |
| 2016/0076863 | A1 | 3/2016 | Pedersen | |
| 2016/0273892 | A1 | 9/2016 | Pedersen | |
| 2016/0273893 | A1 | 9/2016 | Pedersen | |

* cited by examiner

MECHANICAL BROADHEAD

BACKGROUND OF THE INVENTION

The present invention relates generally to a mechanical broadhead, and more particularly, to a mechanical broadhead including movable blades, such as rearward deploying/sliding blades or pivoting blades.

A mechanical broadhead, sometimes referred to as an expanding blade broadhead, includes blades joined with a ferrule so that the blades can move from a retracted in-flight position to a deployed position upon engagement with a target. Mechanical broadheads generally have the flight characteristics of a field point, yet the penetration and cutting characteristics of a fixed blade broadhead.

One type of mechanical broadhead is a pivoting blade broadhead. This broadhead includes blades located in a slot defined by a ferrule so that the cutting edges of the blades face inward in the retracted, in-flight position. The blades are pivotally joined with the ferrule at their rear so they can rotate from the retracted, in-flight position to a deployed position on impact with the target. In the deployed position, the cutting edges of the blades face outward so that they can enhance penetration and cutting action.

Another type of mechanical broadhead is a rearward deploying or sliding blade broadhead. Such broadheads generally include blades having cutting edges that always face outwardly, and that are designed to slide rearward relative to a ferrule from a retracted in-flight mode to a deployed mode.

Almost all mechanical broadheads include a mechanism to retain the blades in a retracted mode while the broadhead is in-flight. Some rearward deploying broadheads and some pivoting broadheads use O-rings, wraps or bands secured around the blades and the ferrule to hold the blades in-flight. When the blades deploy, these devices are cut, or roll or slide off the broadhead. Many of these devices, however, are prone to rotting or cracking, which can lead to failure of the device, and possibly the unintended and undesirable opening of the blades in-flight. Some pivoting blade broadheads use blade detents or a plunger system located internally within the ferrule to secure the pivoting blades in the in-flight position.

Yet other rearward deploying broadheads utilize metal retaining clips that push outward on a blade to urge and maintain the blade in a retracted state. Such clips are commercially available from G5 Outdoors, LLC, and are generally disclosed in U.S. Pat. No. 8,449,416 to Grace et al. While the clips can retain blades in a retained state, they can be complicated and sometimes difficult to use.

SUMMARY OF THE INVENTION

A mechanical broadhead having blades movable from a retracted mode to a deployed mode is provided including an external retainer element which holds the blades in the retracted mode, but also selectively releases the blades so that they can move to the deployed mode.

In one embodiment, the broadhead includes a ferrule having an exterior and defining a ferrule slot, and a blade movably positioned in the ferrule slot, and a retraction element that secures the blade in the retracted mode. The blade can include a first ball and socket member located adjacent the exterior of the ferrule. The retaining element can include a second ball and socket member also located adjacent the exterior of the ferrule. The second ball and socket member engages the first ball and socket member to hold the blade in the retracted mode. The ball and socket members provide an efficient and secure way to lock and release the blades.

In another embodiment, the ball and socket members, which can be on the blades and/or on the retainer element, can be snapped together to provide an audible sound confirming locking of the blades in the retracted mode. In this manner, a user can audibly perceive that the blades are secured in the retracted mode.

In yet another embodiment, the ferrule includes a retainer element indexing recess and the retainer element includes a collar with an indexing projection extending upwardly from the collar. The indexing projection is able to be registered in the retainer element indexing recess so that the first ball and socket member precisely aligns with the second ball and socket member. This can facilitate quick and easy assembly and repair of the broadhead.

In still another embodiment, the blade can be constructed so that it engages the ferrule and retainer element at only two regions. For example, the blade can include a fulcrum. The blade only engages the ferrule at the fulcrum, and only engages the retainer element at the first ball and socket member. This enables the blade to have only two regions of contact to connect the blade to the broadhead. This can minimize friction on blade deployment, and simplify movement of the blades.

In still yet another embodiment, the ball and socket member of the blade can be configured to travel on different paths when the blade is being converted to a retracted mode, versus when the blade is being deployed to the deployed mode. For example, the blade ball and socket member can travel radially, along a first path toward a longitudinal axis of the ferrule when the blade is being converted to the retracted mode. The blade ball and socket member alternatively can travel along a second path parallel to a longitudinal axis of the ferrule, and transverse to the first path, when the blade is initially being deployed to a deployed mode from the retracted mode. These different travel paths can facilitate efficient installation and deployment of the blades.

In a further embodiment, the broadhead can include first and second ferrule portions removably joined with one another. The second ferrule portion can acquire a blocking mode to block a removal opening of a ferrule slot defined in the first ferrule portion so that the blade cannot be removed from the slot. The second ferrule portion can achieve a removal mode so that the blade can be removed from the slot.

In yet a further embodiment, the first ferrule portion can define a cavity that is in communication with the removal opening. In the blocking mode, the second ferrule portion can be disposed in the cavity and can obstruct the removal opening. Optionally, the second ferrule portion and the cavity can include corresponding threads. The second ferrule portion can be unthreaded and removed at least partially from the first ferrule portion to achieve the removal mode.

The broadhead of the embodiments herein provides an efficient mechanism by which to securely hold blades of the broadhead in a retracted mode. When utilized, the retainer element can withstand the elements and generally is of a durable, long lasting and optionally reusable construction. Further, the two-part ferrule can provide an efficient way to secure and guide movable blades, yet provide easy access for repair and replacement of the same.

These and other objects, advantages and features of the invention will be more readily understood and appreciated by reference to the detailed description of the current embodiments and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION OF THE CURRENT EMBODIMENTS

A current embodiment of the broadhead is shown in FIGS. 1-9 and generally designated 10. The broadhead can include a retainer element 20 and one or more blades 30 joined with a ferrule 40. For purposes of disclosure, the broadhead is described in connection with use on an archery arrow, however, the broadhead is well suited for use with any projectile.

Figure 1:
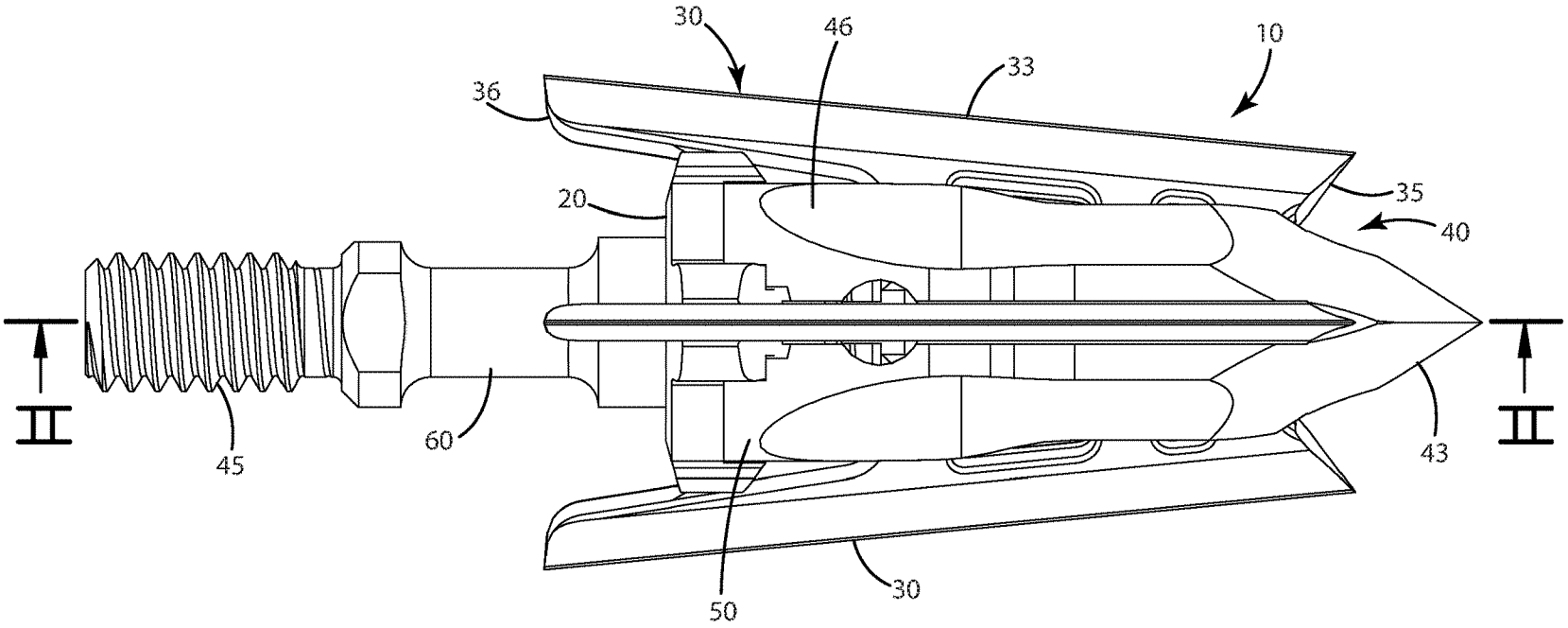
FIG. 1 is a side view of a broadhead of a current embodiment with the blades in a retracted mode.
Figure 2:
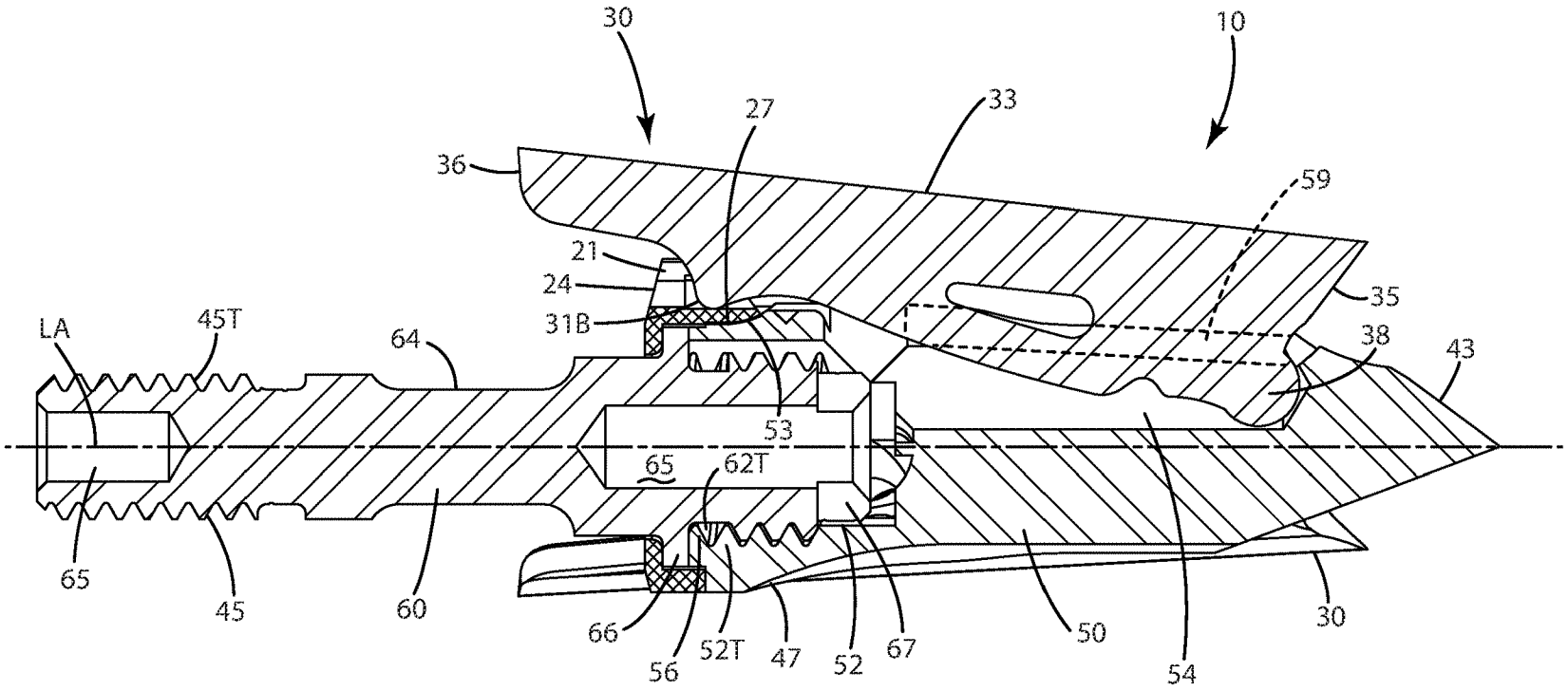
FIG. 2 is a section view thereof.
Figure 3:
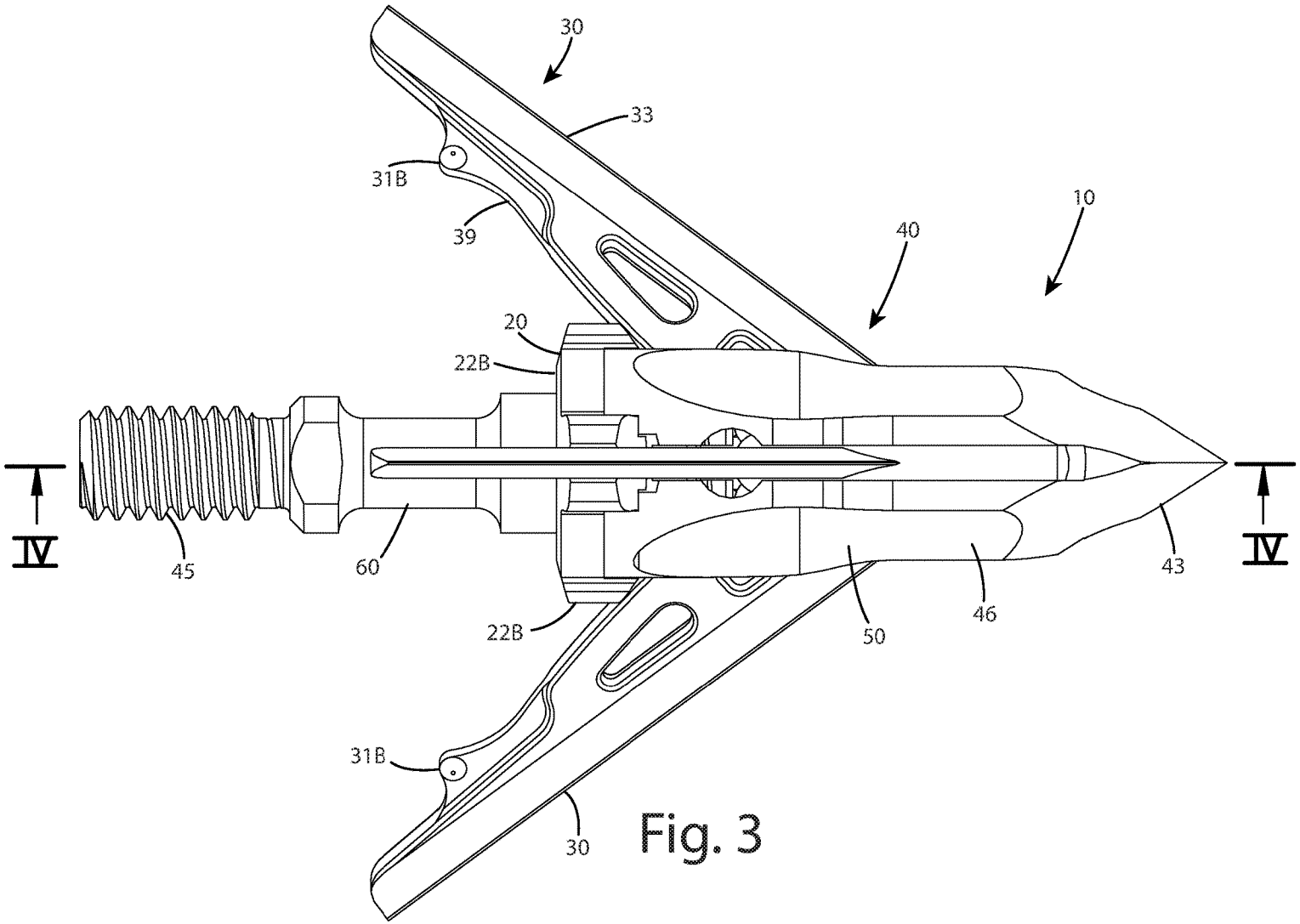
FIG. 3 is a side view of the broadhead with the blades in a deployed mode.

The broadhead of the current embodiment can be a rearward deploying, sliding blade type broadhead. This type of broadhead transitions from a retracted mode as shown in FIGS. 1-2 to a retracted mode shown in FIGS. 3-4. In the retracted mode, the broadhead is of a smaller cross section so that it performs well in flight. In the expanded mode, the blades 30 are rearwardly deployed to increase the cutting area of the broadhead. The constructions herein also are suitable for use with other rearward deploying broadheads, such as those disclosed in U.S. Pat. No. 6,935,976 to Grace, and U.S. Pat. No. 8,449,416 to Grace, both of which are hereby incorporated by reference. Of course, the constructions herein are also suited for use with rearward pivoting type broadheads, of the type generally disclosed in U.S. Pat. No. 6,595,881 to Grace, which is hereby incorporated by reference.

Returning to FIGS. 1-4, the broadhead 10 includes a ferrule 40. The forward portion of the ferrule 40 includes a penetrating tip 43. The penetrating tip may be an integral or removable feature, and can be sharpened to enhance penetration upon engagement with a target. The rearward end of the ferrule includes a stem 45. The stem 45 can include threads or other suitable structures to enable attachment of the ferrule 40 to an arrow insert or more generally to an arrow (not shown). The ferrule 40 further can define a longitudinal axis LA that extends longitudinally along the length of the ferrule 40, generally through the center of the ferrule.

The ferrule 40 can include a first ferrule portion 50 and a second ferrule portion 60. The first ferrule portion 50 can include the penetrating tip 43. The second portion can include the stem 45. The first and second ferrule portions can be removably joined with one another. For example, the first ferrule portion 50 can include a cavity 52 defined inwardly from an exterior surface 46 of the ferrule 40 and in particular the first ferrule portion 50. This cavity 52 can include a threaded portion 52T. The second ferrule portion 60 can include a second threaded portion 62T. The second set of threads 62T can be separated from the stem threads 45T that join the broadhead 10 to an arrow insert by an unthreaded middle section 64. Of course, this middle section 64 can in some cases be threaded, and optionally, the entire second portion can be threaded from one end to the other. As shown, however, the second portion 60 can include its own internal cavities 65 four weight savings and/or to calibrate the broadhead to a particular grain/weight. The second portion 60 also can include a seating flange 66 that seats against a rearward shoulder 56 of the first ferrule portion 50 when the second portion is fully installed in the first portion and relative to the first portion 50.

Figure 4:
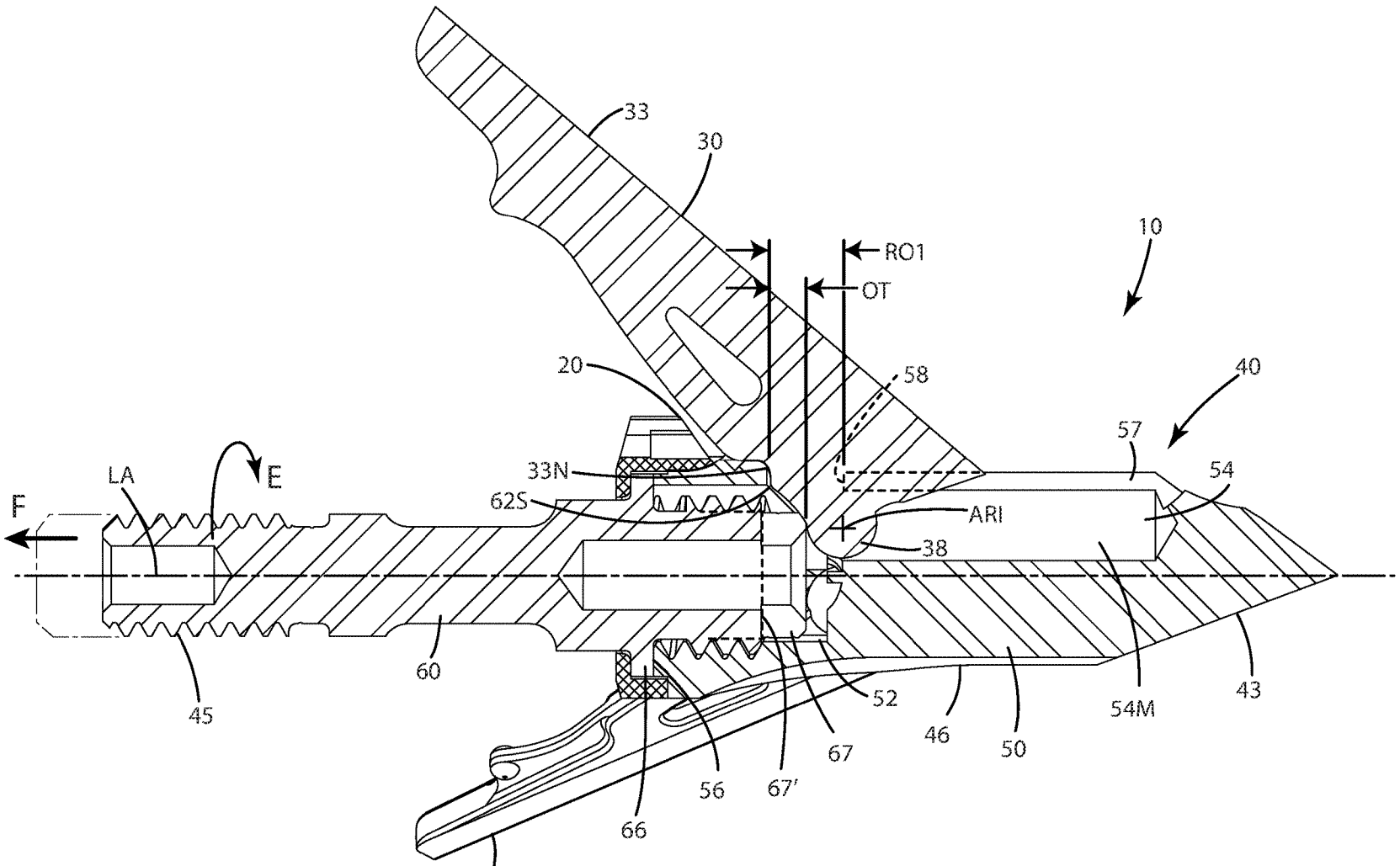
FIG. 4 is a section view thereof.
Figure 5:
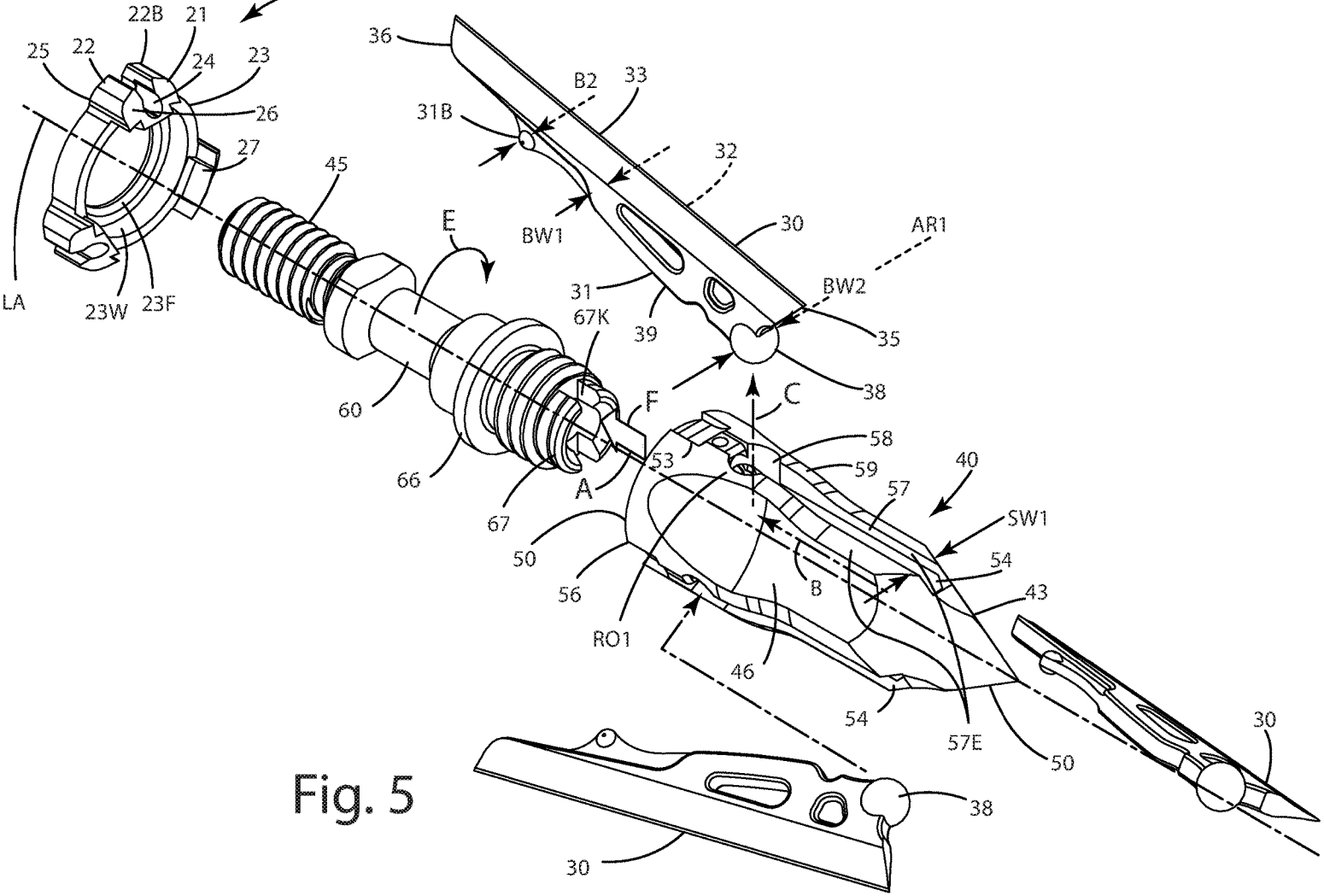
FIG. 5 is an exploded view of the broadhead.

As shown in FIGS. 2, 4 and 5, the first ferrule portion 50 can define ferrule slots 54 that extend longitudinally parallel to the longitudinal axis. The ferrule slots can be configured to accommodate a portion of the blades 30 as described below. The ferrule slots 54 can be of a T-shaped or keyhole structure with a fulcrum 38 of the blade extending transversely to the longitudinal axis LA and movably registered within the slots 54. Each ferrule slot 54 can include a blade sliding portion 57 and a removal opening 58. The blade sliding portion 57 can be of a width SW1 that is sufficient to enable the blade 30 to slide with its first and second sides 31 and 32 immediately adjacent the edges of the blade sliding portion 57. The width of the blade 30 from one side surface 31 to the second side surface 32 is a blade with BW1. This blade width BW1 is less than the slot width SW1, so that the fulcrum portion of the blade can slide in the slot. The blade 30 also can include a second blade width BW2 associated with and measured at the fulcrum 38. This width BW2 is greater than the width SW1 of the blade sliding portion 57 of the slot. Accordingly, when the fulcrum 38 is slidably journaled in the slot 54, the fulcrum cannot protrude through or exit through the blade sliding portion 57. In this manner, the fulcrum is entrapped in the slot 54 generally under the opposing edges 57E of the blade sliding portion 57.

The slot 54 also can include a removal opening 58. This removal opening can be formed at a terminal and of the ferrule slot 54. Although shown as a generally closed opening 58 that only opens to the remainder of the sliding blade portion 57, this opening can alternatively be constructed to extend completely to the rearward end or shoulder 56 of the first ferrule portion 50. Thus, the ends of each slot 54 would open at the end 56 of the first ferrule portion 50. As illustrated however, the removal openings 58 can be closed to the environment and in communication with the ferrule slots 54.

As illustrated in FIGS. 4 and 5, the fulcrum 38 can be a partially spherical element, sometimes referred to as a ball herein. This element can be journaled in the main cavity 54M of the ferrule slot 54 and can slide along and/or within it. The main cavity 54M can have a similar rounded in/or circular cross-section to receive the rounded fulcrum 38 as shown. In other constructions, the fulcrum can be of other geometric shapes. For example, it can be cylindrical with a longitudinal axis of the cylinder transverse to the longitudinal axis LA of the broadhead. Alternatively, can be polygonal, for example, in the form of a rectangle. In these other constructions, the main cavity 54M can be similarly shaped to receive the fulcrum 38. It also is to be noted that although referred to as a fulcrum, the fulcrum 38 might not necessarily be a point or location about which the blade 30 rotates. Although, as shown, it generally can rotate about the fulcrum 38, or at least a portion of it. Optionally, the fulcrum 38 can be replaced with any suitable feature adapted to engage the ferrule slot and enable the blade to rotate generally about the axis of rotation AR1 in deploying from a retracted mode to a deployed mode.

As shown in FIGS. 2, 4 and 5, the first 50 and second 60 ferrule portions can be removably joined with one another in a particular manner to entrap the fulcrum 38 in the main cavity 54M and in the slot 54 so that the fulcrum does not readily escape the same and so the blade remains associated with the ferrule 40. In particular, the second ferrule portion can include a removal opening obstruction portion 67. This obstruction portion 67 can be distanced from the seating flange 66 a particular distance so that when the second portion 60 is threaded into the first portion 50, the obstruction portion 67 obstructs at least a portion of the removal opening 58. As shown in FIG. 4, the removal opening obstruction portion 67 can project into the cavity 52 of the first ferrule portion 50. The obstruction portion 67 also can obstruct the removal opening 58 by a distance or amount OT. This distance OT can be a minor portion of the removal opening 58, a major portion of the removal opening 58 or slightly more than half of the removal opening 58, depending on the application. With the obstruction portion 67 obstructing the removal opening 58, the fulcrum 38 as shown in FIG. 4 engages the removal opening obstruction portion 67 and the interior surfaces of the ferrule main cavity 54M. Accordingly, that fulcrum 38 cannot exit through the removal opening 58 because the size of the opening has been reduced to dimensions that are less than the dimensions of the fulcrum 38.

In some cases, it is helpful to remove and replace blades 30 relative to the ferrule 40. The first and second ferrule portions 50 and 60 are suitable for this activity. For example, as shown in FIGS. 4 and 5, a user can unthread or rotate the second ferrule portion 60 in direction E as shown. The second portion 60 thus moves in direction F. The threads 62T unthread from the threads 52T. In turn, the removal opening obstruction portion 67 is at least partially removed from the cavity 52. As a result, the removal obstruction portion 67 moves to the location of the obstruction portion 67' shown in FIG. 4 in broken lines of portion 67'. In this configuration, or when the second portion 60 is removed from the first portion 50, the second portion is in a removed mode. In the removed mode, the dimension of the removal opening RO1 of the removal opening 58 is no longer obstructed. Accordingly, as shown in FIG. 5, the fulcrum 38 can be moved in direction B down and within the ferrule slot. Thus, the fulcrum can be pulled out in a transverse direction to remove the blade 30 from the ferrule 40. Optionally, the removal opening obstruction portion 67 can be in the form of an annular and/or cylindrical protrusion that is at least partially hollow and defines a portion of a cavity 65. In some cases, the obstructing portion 67 also can include a key way 67K. This keyway can be engageable by a tool to optionally remove the second portion 60 from an arrow.

In some cases, the second portion 60 can be completely removed from the first portion to provide service and repair to various components of the broadhead. This is illustrated in FIG. 5 with complete removal of all the major components of the broadhead.

To install the blade 30, the fulcrum 38 is moved through the removal opening 58 and into the main cavity 54M of the ferrule slot 54. The blade can be slid forward, toward the penetrating end 43. The second portion 60 can be installed and rotated in a reverse direction of E thereafter, and threaded into the cavity 52 until the seating flange 66 seats against the rearward edge 56 of the first ferrule portion 50. When the seating occurs, the removal opening obstruction portion 67 obstructs and blocks the removal opening in a blocking mode so that the blade cannot be removed. In particular, the fulcrum 38 cannot be moved through the removal opening 58.

Optionally, the removal opening 58 forms a terminal end of the ferrule slot 54. In this manner, the removal opening opens outward, through a sidewall 59 of the ferrule first portion. Thus, in this construction, the ferrule slot and removal opening are fully bounded by the sidewall 59 and generally some portion of the first ferrule portion 50.

Further optionally, the various ferrule slots 54 can be discontinuous and separated from one another by structure of the first ferrule portion 50. Those slots however can be in communication with and can open up to the cavity 52 within which the second portion 60 is inserted. Generally, each of the ferrule slots 54 can be offset from and parallel to the longitudinal axis LA. The cavity 52 may be centered on the longitudinal axis LA.

As shown in FIGS. 1-5, the ferrule 40 can define an exterior surface 46 which is generally the surface that is open and visible to a casual observer of the broadhead when installed on an arrow or generally in an assembled state. The exterior surface 46 can include all the visible surface on the exterior of the ferrule. The exterior surface 46 can be differentiated from the interior of the cavity 52 and the ferrule slots 54 of the broadhead which have interiors that are generally not visible to a casual observer of the broadhead when it is in an assembled state, except perhaps through the removal openings in some cases. The interior cavities and slots of the broadhead can house or include any internal compartments or components. The interior portions of the cavity 52 and of the ferrule slots 41 are located on the interior of the ferrule 40 while the penetrating tip 42, cutting edges 33, ball and socket members 31B, 22B, and the retainer element 20 are disposed on or adjacent the exterior surface of the ferrule 40, generally outside the ferrule.

The blades 30 are movably joined with the ferrule 40, and are configured to translate from a retracted mode to a deployed mode as shown in comparing FIGS. 1-2 to FIGS. 3-4. Each blade can include a forward end 35 and a rearward end 36. A cutting edge 33 can extend from the forward end 35 to the rearward end 36. The cutting edge can be sufficiently sharp to cut tissue or any other target that the broadhead 10 engages. The blades 30 can include an inner edge, which is located inward, closer to the longitudinal axis LA than the cutting edge 33. In the illustrated rearwardly deploying broadhead, the cutting edge 33 remains positioned radially outwardly relative to the longitudinal axis LA, that is, it faces outward in both the retracted mode and in the deployed mode. The inner edge 39 also remains facing generally inwardly, radially toward the longitudinal axis LA in both the retracted mode and the deployed mode.

Generally, each blade 30 can be movably positioned in each ferrule slot 54, which means that each blade can slide and/or rotate relative to the ferrule 40 in the ferrule slot 54. In some embodiments herein, the blade 30 can slide relative to the slot away from the penetrating tip 43. Simultaneously, or at some other time, the blade can rotate about the axis of rotation AR1. In other embodiments, the blade can be movably positioned in the ferrule slot and can rotate in or out of the ferrule slot about a fixed axis of rotation.

As mentioned above, the blades 30 and the retainer element 20 can include a first ball and socket member 31B associated with the blades 30, and a second ball and socket member 22B associated with the retainer element 20. As shown in FIG. 5, the first ball and socket member 31B can be disposed on an inside and/or rear edge 39 of the blade. The first ball and socket member 31B, can be closer to the rear end 36 of the blade 30. The first ball and socket member 31B also can be distal from the fulcrum 38 located near the forward end 35 of the blade 30. The ball and socket member 31B can come in many forms. Optionally, the member 31B can be in the form of a partially rounded and/or partially spherical element that projects from the rear edge 39 of the blade 30. Further optionally, the geometric shape of the ball and socket member 31B can be said to be in the shape of a "ball", or at least part of a ball, of the ball and socket. This can be accurate even though the member 31B is not in the shape of a perfect sphere or perfect ball. As another option, the member 31B can be in the form of a protrusion, a projection, a boss and/or a rotatable, mass increasing feature. The exterior surfaces of the member 31B can be substantially rounded, and/or can include multiple polygonal facets.

Although the current embodiment illustrates three corresponding sets of ball and socket members dedicated to each of the three individual blades of the broadhead, there can be different numbers of the sets of ball and socket members. For example, where there is only two blades, two sets of ball and socket members can be included in the broadhead. Where there are four blades, four sets of corresponding ball and socket members can be included in the broadhead.

Figure 6:
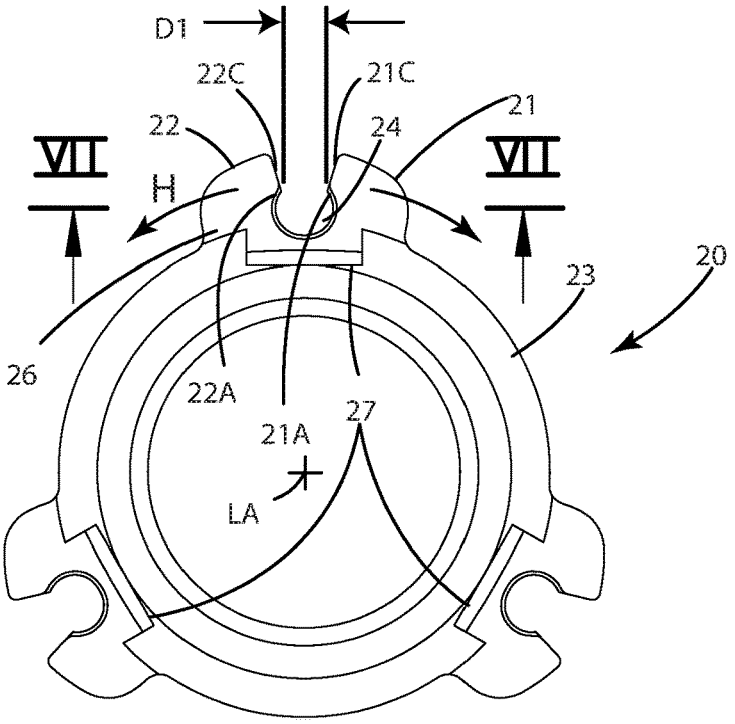
FIG. 6 is a top view of the retraction element of the broadhead.
Figure 7:
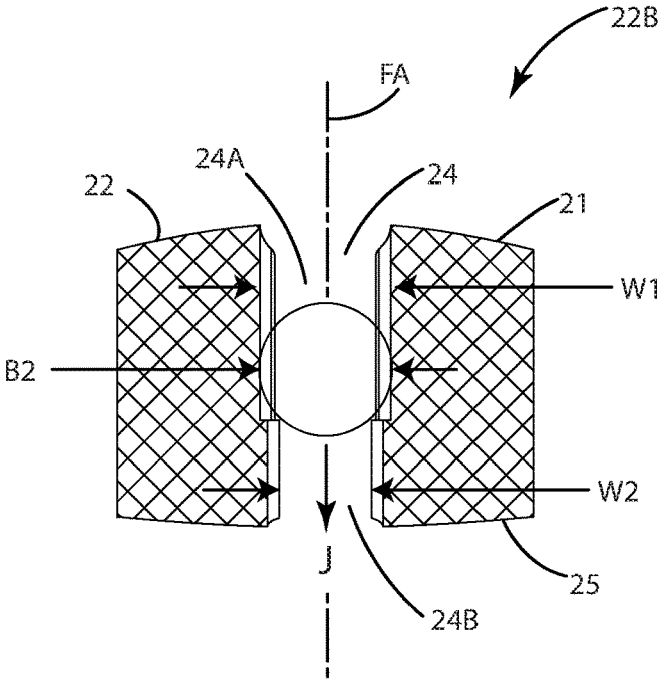
FIG. 7 is a close up view of fingers of the retainer element.

The second ball and socket member 22B shown in FIGS. 5-7 can be in the form of a socket having one or more open ends. The second ball and socket member 22B can include first 21 and second 22 fingers that extend outwardly from an annular collar or ring 23. These fingers, and the remainder of the retainer element 20, can be constructed from resilient materials. Suitable materials can include ABS, polycarbonate, and other low friction thermoplastic polymers. Of course, in some cases metals and composites can be substituted therefore. Optionally, the second ball and socket member 22B can be in the form of a partial and/or full cavity that mimics an exterior surface of the member 31B. Further optionally, the second member 22B can include one or more additional fingers to restrain and/or secure the first member 31B.

As shown in FIGS. 5-6, the fingers 21 and 22 can be separated from one another by a first distance D1 when the second ball and socket member 22B is not engaged with the first ball and socket member 31B. The distance D1 can be measured in between the respective apexes is 21A and 22A. Because the fingers 21 and 22 are resilient, when the second ball and socket member 31B enters the socket portion 24 of the ball and socket member 22B, fingers 21 and 22 can move in direction H slightly to increase the distance D1 to a second, greater distance. The distance D1 can be greater then a maximum width B2 of the ball and socket member 31B. When the distance D1 is increased to a greater distance upon movement in of the fingers direction H, this can enable the second ball and socket member 22B to slightly deform and open, to enable the first ball and socket member 31B to enter into the socket portion 24.

As shown, the socket portion 24 of the ball and socket member 22B can be in the form of an elongated cylinder that is partially opened on one side. Of course other types of geometric configurations can be selected for the shape of the socket portion 24, For example, the socket portion can be in the form of a polygonal tube or opening, or the socket portion can be in the shape of a fully rounded or partially spherical socket opening, that may or may not be substantially closed. Optionally, although the second ball and socket member 22B can be referred to as the socket, that socket need not be a fully or substantially closed cavity, and can be partially and/or substantially open in one or more regions to allow the ball of the first ball and socket member 31B to enter and exit the socket. The socket portion 24 can extend from a lower end 25 to an upper end 26 of the retainer element 20.

Optionally, the elongated cylinder forming the second portion 24 can include different dimensions. For example, as shown in FIG. 7, the socket portion 24 can be of a first width W1 and a second width W2. The first width W1 can be slightly greater than the second width W2. The first ball and socket member 31B can be sized to precisely fit within the width W1, but slightly oversized and unable to fit precisely in the width W2 of the socket portion 24. As a further example, the maximum width B2 of the ball and socket member 31B can be slightly less than or equal to the width W1 of the upper portion 24A of the socket portion 24, but greater than the width W2 of the lower portion 24B of the socket portion 24. When the blades are in the retracted mode, and the first ball and socket member engages the second ball and socket member, the lower portion 24B of the socket portion 24 can prevent those blades from inadvertently slipping downwardly relative to the ferrule and inadvertently deploying. Of course, during deployment, the ball 31B can move in direction J for a distance, in which case the ball and the blade moves parallel to the longitudinal axis LA of the blade upon initial deployment. After further deployment, for example, where the ball 31B clears the lower end 25 of the ball and socket member 22B, the ball and blade can move arcuately and/or linearly outward relative to the longitudinal axis.

Optionally, the ball and socket member 22B can include opposing chamfered, radiused or tapered surfaces 21C and 22C on the opposing fingers 21 and 22 respectively. These surfaces can transition to respective apexes 21A and 22A of the fingers. These surfaces or portions 21C and 22C can facilitate and guide the ball 31B between the apexes 21A and 22A so that the ball enters the socket portion 24. With these surfaces, the ball 31B can exert outward forces against the surfaces to resiliently bias the fingers 21, 22 slightly away from one another in direction H as described above. As the ball 31B moves through and passes the apexes, the distance D1 increases to a second grader distance so that the gap between the fingers effectively enlarges. After the ball clears the apexes, it enters the portion 24A of the socket portion 24.

When this occurs, the fingers 21 and 22 move in opposite directions, of direction H, back toward their original configuration with the gap between the fingers set at D1.

Figure 8:
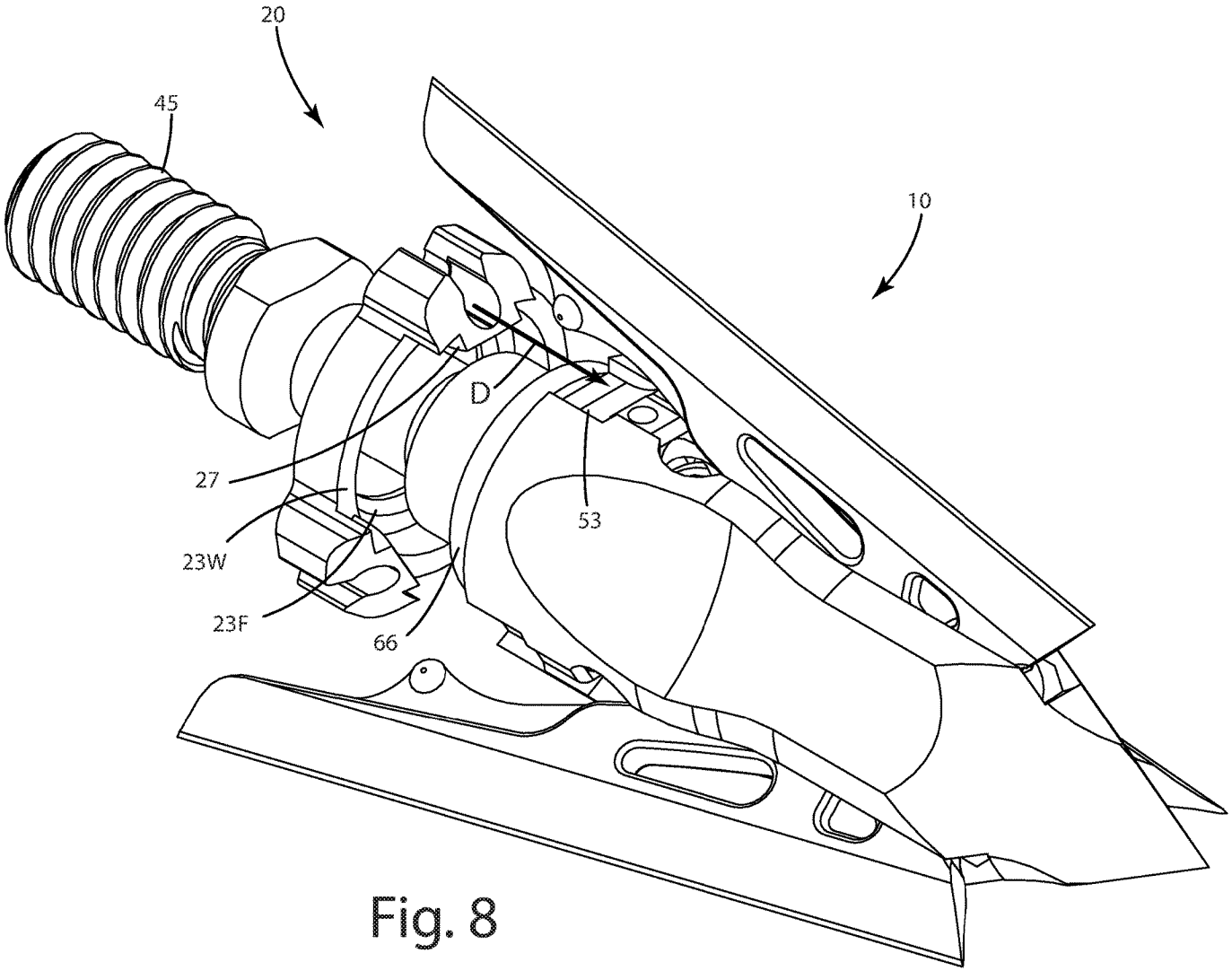
FIG. 8 is perspective view of the broadhead with the retainer element being aligned with the blades.
Figure 9:
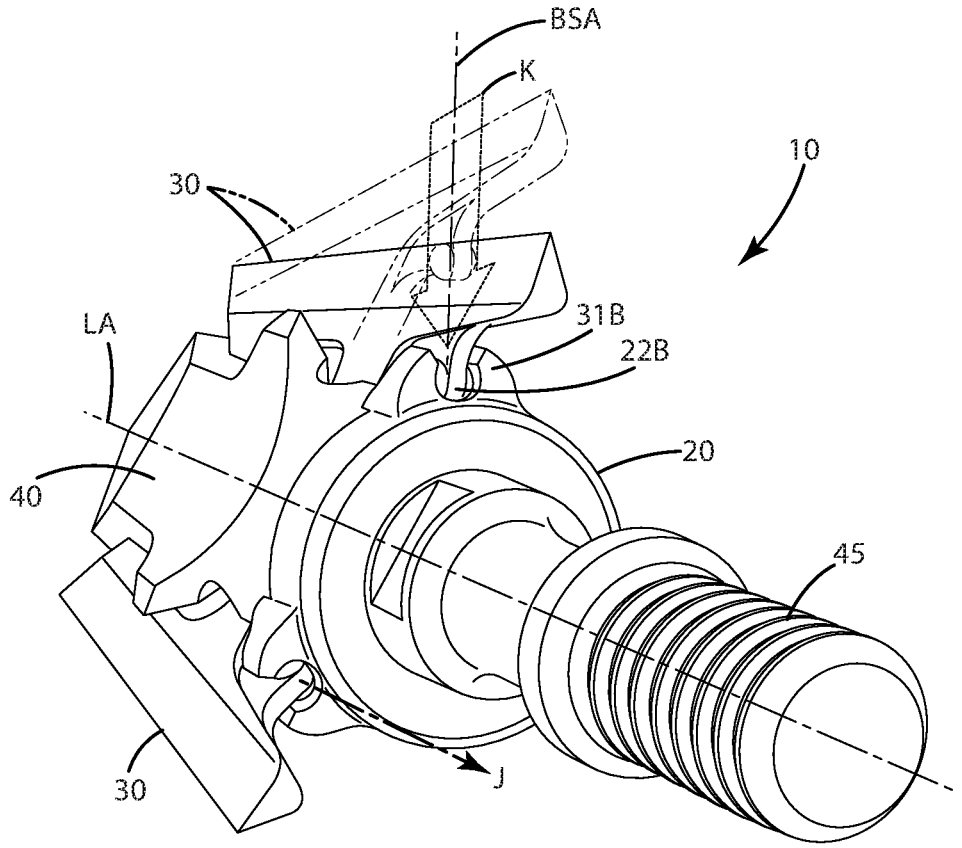
FIG. 9 is a rear perspective view of a blade being secured in a retracted mode using first and second all and socket members.

With reference to FIG. 9, the blades 30 can be positioned in a secured orientation relative to the ferrule 40 via an interaction of the first ball and socket member 31B of the blade 30 and the second ball and socket member 22B associated with the retainer element 20. In particular, the blades and retainer element 20 can be constructed so that the ball and socket member 31B can move along a ball and socket axis BSA that is transverse, and optionally perpendicular to, the longitudinal axis LA. As the ball and socket member 31B moves in direction K along the axis BSA, it engages the fingers 21 and 22 of the second ball and socket member 22B to open them up and enable the ball 31B to enter the socket portion 24. When the resilient fingers snap back in a direction opposite that of direction H shown in FIG. 6, the fingers can audibly engage the ball 31B and/or other portions the blade 30. In turn, this emits an audible snap or click that is of sufficient decibels for and perception by a human user. In this manner, a user setting the blades 30 relative to the retainer element 20 can confirm via that audible click or snap that the blade is secured in the retracted mode shown in FIGS. 8-9. As mentioned above, however, the first ball and socket member 31B also can travel with the blade 30 in a second direction J that is transverse to the ball and socket axis BSA. This second direction J optionally is, parallel to the longitudinal axis LA. The ball 31B can travel in this direction J for at least a portion of the length of the second ball and socket member 22B, after which, it optionally can move on a linear curvilinear and/or path away from the longitudinal axis. Further optionally, the ball and socket axis BSA can be slightly curvilinear, particularly where the ball 31B moves along an arc established by the fulcrum 38 being seated in the ferrule slot 54. Despite this, is still considered to move transverse and optionally perpendicular to the longitudinal axis LA.

As mentioned above, the retainer element 20 can include a collar 23. The collar 23 can include a flange 23F that can be substantially annular. This flange can be configured to seat against the seating flange 66 of the second ferrule portion 60, as shown in FIGS. 2 and 5. When the flange 23F seats against the flange 66, this establishes the proper location of the second ball and socket member 22B relation to the ferrule. The socket portion 24 can be disposed at a predetermined distance from the fulcrum 38 when the fulcrum is in the ferrule slot 54. This can ensure that the first ball and socket member 31B properly aligns with the fingers of the second ball and socket member 22B.

Optionally, to further ensure alignment of the fingers 21, 22 with the ball and socket member 31B, the retainer element can include indexing projections 27 that extend outwardly from the collar 23. These indexing projections can form at least a portion of the fingers 21 and 22, as well in some cases a portion of the socket portion 24. As shown in FIG. 6, these indexing projections 27 also can extend inwardly toward a longitudinal axis LA of the retainer element 20 and/or the broadhead in general. Optionally, the indexing projections can extend upward from the collar adjacent the exterior surface of the ferrule, on an exterior portion of the collar.

As illustrated in FIG. 8, the indexing projection 27 can be configured to fit within a retainer element indexing recess 53 that is defined by the ferrule 40 and more particularly by the first ferrule portion 50. There, the indexing projection 27 can be seen moving into the indexing recess 53 in direction D. The indexing recess 53 can be aligned with and centered on the centerline of the ferrules slot 54. The recess also can be of a width that is slightly greater than the width of the indexing projections 27. Optionally, the indexing recess 53 can transition to the removal opening 58 and/or the ferrule slot 54. The indexing recess can be of a shallower depth and/or not extend through the sidewall 59 of the ferrule 40. In some cases, the indexing recess can be a recess in the exterior surface 46 of the ferrule, without extending through a portion of the ferrule to form a through hole therein.

During installation, the indexing projections 27 can be gently slid into the indexing recesses 53 in direction D as shown in FIG. 8. When the indexing projections are fully nested or seated within the indexing recesses, the center line FA of the second ball and socket member 22B can be centered with the center of the ferrule slot 54 and generally the blade as well. Thus, when the element 20 is placed to register the indexing projections in the indexing recesses, the respective socket portions of each of the second ball and socket members 22B are aligned with the respective ball portions 31B of the blades. There optionally is no additional alignment for a user to attain so that the blades properly lock relative to the retainer element 20 in a secure manner.

Optionally, the collar 23 can include a wall 23W that extends upwardly from the inwardly projecting flange 23F. This wall 23W can extend upwardly along at least a portion of the exterior surface 46 of the first ferrule portion 50 when the retainer element is installed. Further optionally, the flange 23F can engage the seating flange 66 while the wall 23W is disposed adjacent the exterior surface of the flange 66, and further adjacent the exterior surface 46 of the ferrule.

Operation and use of the broadhead 10 will now be described with reference to FIGS. 1-5. As mentioned above, the broadhead 10 is in a retracted mode as shown in FIG. 1. Upon impact with a target, it transitions to a deployed mode shown in FIG. 3. To assemble the broadhead, the blades 30 can be attached the ferrule 40, and the retainer element 20 can be disposed on the ferrule. The first ball and socket members 31B of the blades 30 are engaged with the second ball and socket members 22B of the retainer element 20 to secure the blades 30 in the retracted mode shown in FIGS. 1-2. In particular, with further reference to FIG. 9, the blades 30 can be engaged with the retainer element 20 by moving the first ball and socket member 31B toward and into the second ball and socket member 22B. This movement generally occurs along the ball and socket axis BSA which can be transverse, and optionally linear or curvilinear, relative to the longitudinal axis LA. As the ball and socket member 31B moves in the direction K, the remainder of the blade 30 also can rotate about an axis of rotation AR1 of the fulcrum 38 associated with the blade 30. During the movement of the ball 31B into the socket, the ball engages the fingers 21 and 22 of the second ball and socket member 22B. The ball presses against the surfaces 21C and 22C with force to push the resilient fingers away from one another, increasing the distance D1 to a greater distance. After the ball clears the apexes 21A and 22A, the ball 31B enters into the socket portion 24 and the resilient fingers 21, 22 move in a direction opposite that of the direction H toward one another. When this occurs, the ball and socket member emits an audible snap or click or other sound. When this audible sound is perceived by a user, the user can be confident that the blade is fully secured in the retracted mode as shown in FIGS. 1-2.

When the broadhead 10 is in the retracted mode, the blade engages the ferrule 40 and its portions including the retainer element 20 at substantially only two locations. First, the fulcrum 38 engages the slot 54 and its interior surfaces. Optionally there might be only one region of localized contact between the fulcrum and the inside of the ferrule slot 54. The blade also contacts the second ball and socket member 22B of the retainer element 20 via the first ball and socket member 31 at a second region. Thus, the blade has substantially only two regions of contact with the other immovable components of the broadhead, such as the ferrule and the collar.

When the broadhead 10 engages a target, the target engages the front 35 of the blade 30. As a result of this rearward force, the blade begin to move rearwardly and generally parallel to the longitudinal axis LA. As the blade moves rearwardly, the fulcrum 38 acts a guide as it slides within the ferrule slot 54. The rearward movement also exerts a force on the first ball and socket member 31B upon initial movement of the blade. As a result of this force, the ball and socket member moves generally parallel to the longitudinal axis LA as shown in FIGS. 7-9 in direction J until the ball 31B exits the socket portion 24. After it clears the fingers, the ball 31B can move linearly and/or curvilinearly outward and away from the longitudinal axis LA as the blade rotates about the axis of rotation AR1 of the fulcrum 38 disposed in the slot 54.

Deployment of the blade rearward and outward continues until the stop notch 33 engages the shoulder 62S and/or the fulcrum 38 engages the removal opening obstruction portion 67 of the second ferrule portion 60. This second ferrule portion and in particular the obstruction portion 67 blocks the removal opening 58 when the second ferrule portion is in the blocking mode as shown in FIG. 4. Due to the obstruction portion 67, the fulcrum 38 is arrested in movement and cannot move through the removal opening 58. Thus the blade cannot be removed from the ferrule slot with the second ferrule portion in the blocking mode. Deployment of the blade ceases in this configuration.

In some cases, it can be helpful to replace the blades 30 relative to the broadhead, for example, where they become dulled or bent due to use. To replace a blade, with reference to FIG. 5, the second portion 60 of the ferrule can be rotated in direction E. As a result the threads 62T thread out from the thread 52T of the first ferrule portion 50. This causes the second portion 60 to be at least partially removed from the first portion 50. This achieves a removal mode by moving the obstruction portion 67 along the longitudinal axis and generally away from the ferrule slot 54. As shown in FIG. 4, when the obstruction portion 67' reaches the location shown in broken lines, the second ferrule portion is in a removal mode, and the fulcrum 38 can be slid out and move through the removal opening 58, for example in direction C as shown in FIG. 5. In this manner, the blade can be removed from the ferrule and replaced. Installation can occur by reversing the above steps.

The retainer element 20 also can be replaced relative to the broadhead. As shown in FIG. 8, the indexing projections 27 can be moved in direction D into the indexing recess is 53. In turn, this aligns the second ball and socket member 22B with the first ball and socket member 31B. Thereafter, the blade can be locked via the first and second socket members as shown in FIG. 9 and described above.

The ferrule, blades and other components of the broadhead can be manufactured from metal, composites, polymers, or combinations of the foregoing. Suitable metals include aluminum, stainless steel and/or titanium. If the ferrule is constructed from metal, it can be machined from bar stock or formed using metal injection molding (MIM) optionally followed with a secondary machining operations. If the ferrule or other components are constructed from composites or polymers, the tip and the blades optionally can be manufactured separately from other materials such as metals.

Figure 10:
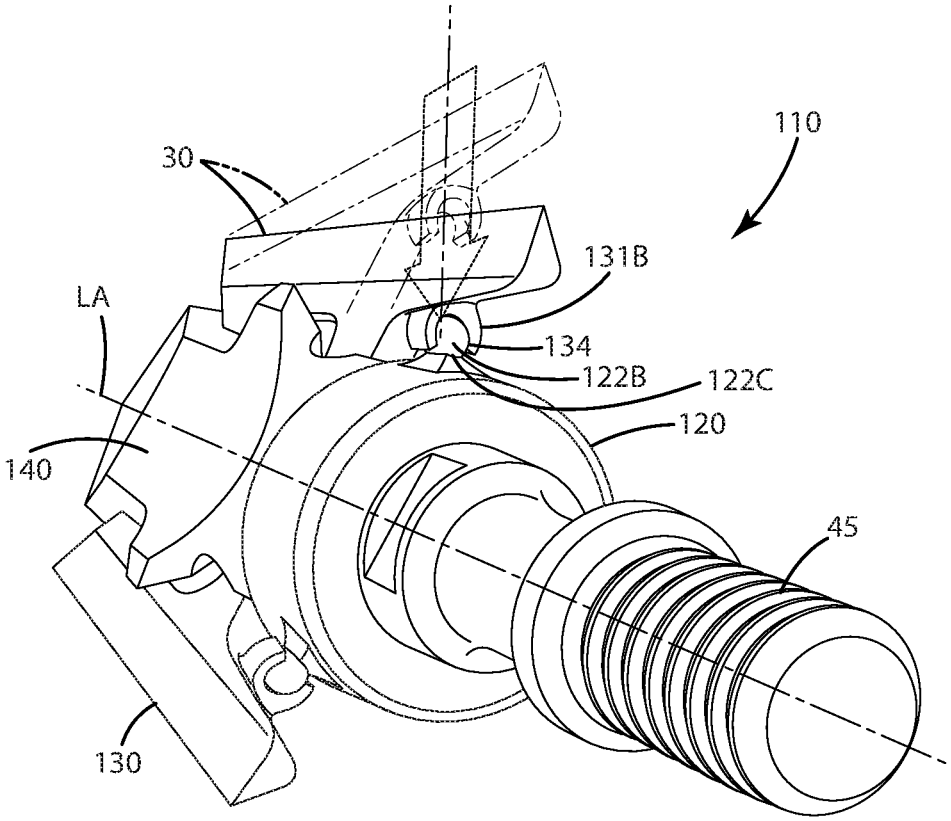
FIG. 10 is a rear perspective view of a first alternative embodiment of the broadhead including alternative ball and socket members.

A first alternative embodiment of the broadhead is shown in FIG. 10 and generally designated 110. This embodiment is similar in construction and operation to the embodiment described above with a few exceptions. For example, the broadhead can include a ferrule 140 and respective blades 130, as well as a retainer element 120. The first ball and socket member and second ball and socket member 131B and 122B however, can be reversed from that of the embodiment above. For example, the retainer element 120 can include a ball portion 122C that is configured to fit into a socket 134 defined by the first ball and socket member 131B. The socket 134 can be similar to that described in the above embodiment on the retainer element. In some cases, however, the respective fingers of this first ball and socket member 131B can be rigid and non-resilient. In such a case, the ball 122C can be more malleable and deformable so that it can deform and/or become more narrow when it is inserted into the socket 134. Operation, use and assembly of the broadhead 110 of this embodiment is similar to that of the embodiment described above.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation. The above description is that of current embodiments of the invention. Various alterations and changes can be made without departing from the spirit and broader aspects of the invention as defined in the appended claims, which are to be interpreted in accordance with the principles of patent law including the doctrine of equivalents.

This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The embodiments of the invention in which an exclusive property or privilege is claimed are defined as follows:

1. An archery broadhead comprising:

a ferrule including a first ferrule portion and a second ferrule portion, the first ferrule portion defining a ferrule slot having a removal opening, the second ferrule portion joined with a stem configured to secure the broadhead to an arrow; and a blade movably positioned in the ferrule slot, the blade configured to be arranged in at least one of a retracted mode and a deployed mode, wherein the first ferrule portion is removably joined with the second ferrule portion such that the second ferrule portion blocks the removal opening when the second ferrule portion is in a blocking mode, wherein the blade cannot be removed from the ferrule slot when the first ferrule portion is joined with the second ferrule portion in the blocking mode.

2. The archery broadhead of claim 1, wherein the blade includes a fulcrum about which the blade rotates so that the blade can be configured in at least one of a retracted mode and a deployed mode, wherein the fulcrum is able to be slidably contained in the ferrule slot, but configured so that the fulcrum can be removed from the removal opening when the second ferrule portion is in a removal mode in which the second ferrule portion does not block the removal opening.

3. The archery broadhead of claim 1, wherein the second ferrule portion includes an obstruction portion, wherein the fulcrum is formed as a ball, wherein the obstruction portion blocks the ball from moving out of the removal opening when the second ferrule portion is in a blocking mode.

4. The archery broadhead of claim 1, wherein the first portion and the second portion are threadably joined with one another.

5. The archery broadhead of claim 1, wherein the ferrule slot includes a terminal end, wherein the first and second ferrule portions are constructed from metal.

6. The archery broadhead of claim 1, wherein the fulcrum includes an axis of rotation of the blade, wherein the second ferrule portion is configured to engage the fulcrum when the blade rotates about the axis of rotation.

7. The archery broadhead of claim 1, wherein the second ferrule portion includes a seating flange that engages the first ferrule portion so that an obstruction portion is placed in the removal opening when the second ferrule portion is in the blocking mode.

8. The archery broadhead of claim 1, wherein the second ferrule portion is configured to move away from the first ferrule portion so that the removal opening is no longer obstructed by the second ferrule portion but the second ferrule portion remains attached to the first ferrule portion.

9. The archery broadhead of claim 8, wherein the second ferrule portion includes an obstruction portion that obstructs a majority of the removal opening when the second ferrule portion is in the blocking mode.

10. The archery broadhead of claim 8, wherein the second ferrule portion includes an obstruction portion that obstructs a minority of the removal opening when the second ferrule portion is in the blocking mode.

11. An archery broadhead comprising:

a ferrule including a first ferrule portion and a second ferrule portion, the first ferrule portion defining a ferrule slot having a removal opening, the second ferrule portion joined with a stem configured to secure the broadhead to an insert of an arrow; and a blade in the ferrule slot, wherein the first ferrule portion is removably joined with the second ferrule portion such that the second ferrule portion blocks the removal opening so the blade is unremovable from the ferrule slot when the second ferrule portion is in a blocking mode.

12. The archery broadhead of claim 11, wherein the second ferrule includes a seating flange and an obstruction portion spaced a distance from the seating flange such that when the second ferrule portion is joined with the first ferrule portion, the seating flange engages the first ferrule portion and the obstruction portion obstructs at least a portion of the removal opening.

13. The archery broadhead of claim 12, wherein the obstruction portion obstructs at least half of the removal opening.

14. The archery broadhead of claim 11, wherein the blade includes a fulcrum that is ball shaped.

15. The archery broadhead of claim 11, wherein the first ferrule defines a cavity, wherein the ferrule slot opens to the cavity, wherein the second ferrule portion is at least partially disposed in the cavity.

16. An archery broadhead comprising:

a first ferrule portion defining a cavity and a ferrule slot, the ferrule slot opening to the cavity and to a removal opening;

a blade movably disposed in the ferrule slot, the blade including a fulcrum;

a second ferrule portion including an obstruction portion that is removably disposed in the removal opening to selectively prevent the fulcrum from exiting the removal opening when the second ferrule portion is in a blocking mode; and wherein the second ferrule portion is operable in the blocking mode and a removal mode in which the second ferrule portion is configured to be moved relative to the cavity such that the obstruction portion no longer blocks the removal opening so that the fulcrum can pass through the removal opening to remove the blade from the ferrule slot.

* * * * *